US006283346B1

(12) United States Patent
Thomas

(10) Patent No.: US 6,283,346 B1
(45) Date of Patent: Sep. 4, 2001

(54) UTILITY-BOTTLE-NECK-STRAP

(76) Inventor: Johnnie Marshall Thomas, 1320 Gust Lane, Chesapeake, VA (US) 23323

( * ) Notice: Subject to any disclaimer, the term of this patent is extended or adjusted under 35 U.S.C. 154(b) by 0 days.

(21) Appl. No.: 09/514,601

(22) Filed: Feb. 28, 2000

(51) Int. Cl.[7] ..... A45F 5/00

(52) U.S. Cl. ..... 224/148.6; 224/257; 215/396; 215/399; 220/751; 220/754; 220/759

(58) Field of Search ..... 224/148.1, 148.5, 224/148.6, 148.7, 257; 215/396, 399; 220/751, 754, 756, 759

(56) References Cited

U.S. PATENT DOCUMENTS

D. 286,859 * 11/1986 Wu ..... 224/148.4 X
3,807,679 * 4/1974 Burke et al. ..... 215/396 X
5,203,481 * 4/1993 Dobbins et al. ..... 224/148.1
5,573,152 * 11/1996 Arnold ..... 224/148.4
5,577,647 * 11/1996 Pittarelli et al. ..... 224/148.6
5,695,232 * 12/1997 Tipp ..... 215/396 X
5,749,490 * 5/1998 Keicher ..... 215/396 X
5,765,888 * 6/1998 Stack ..... 224/148.4 X
5,890,635 * 4/1999 Wu et al. ..... 224/148.4
5,954,247 * 9/1999 Savine et al. ..... 224/148.4
6,029,870 * 2/2000 Giacona, III ..... 224/148.6

* cited by examiner

*Primary Examiner*—Stephen K. Cronin
(74) *Attorney, Agent, or Firm*—Donald C. Casey, Esq

(57) ABSTRACT

A strap is disclosed comprising a bottle-neck-strap-hole (13) with the measurements predetermined, in accordance with the bottle-neck size, the bottle-neck-strap-hole is cut to fit tightly around a bottle-neck. The bottle-neck-strap is designed to be worn comfortably over the shoulder, around the neck or hung on an object. The Bottle-neck-strap (10) made out of ethylene-vinyl-acetate, which has a hand like foam rubber, is a preferred practical application of this invention. This invention can also be made in a two piece bottle-neck-strap, with the area around the bottle-neck-strap-hole (13) referred to as a bottle-neck-collar (15). A rope, cord or string can be attached to the hole (16) at each end of the bottle-neck-collar; this completes the utility-bottle-neck-strap design.

3 Claims, 3 Drawing Sheets

UTILITY-BOTTLE-NECK-STRAP

FIELD OF THE INVENTION

This invention relates to a Bottle-Neck-Strap for shampoo, liquid soap, sunscreen lotion, water bottles and many other bottle products. It can be worn around the neck or hung on something; bottles, that it is attached to becomes more accessible.

BACKGROUND FIELD OF INVENTION

This invention relates to a foam rubber strap, specifically to such straps which can be attached to bottles and tubes that are used for liquid soap, shampoo, suntan-lotion, and many other bottle products.

SUMMARY OF THE INVENTION

All of the objects of the present invention and others evident to those skilled in the art are fulfilled by a flat strap wherein the flat strap has a hole which is fitted around a bottle neck; the strap is then used to hang, hold or carry specific bottle products, and the strap is a simple device that is used to carry or hang an object on something.

The strap material may be any flexible material or fabric useful for straps; polyurethane fabric, polypropylene fabric, cotton, silk, ethylene-vinyl-acetate, arc all representative useful materials for the practice of this invention. The bottle neck strap of this invention is intended to make a bottle attach thereto more accessible.

Accordingly, besides the objects and advantages of the bottle-neck-strap described in my above patent, several objects and advantages of the present invention are:

(A) to provide a bottle-neck-strap produced in a variety of colors without reguiring the manufacturer to use a compounding facility for production of pigments;

(B) to provide a bottle-neck-strap which can be manufactured in high volume at minimal cost;

(C) to provide a bottle-neck-strap which is comfortable to wear around the neck or over the shoulder;

(D) To provide a bottle-neck-strap which can be cut in many different shapes and designs;

(E) to provide a bottle-neck-strap which will present a superior surface for the reception of graphic design or print;

(F) to provide a bottle-neck-strap that alows one to take a shower or bath in a public place with ligiuid soap or shampoo kept at a hands reach.

(G) to provide a bottle-neck-strap that can be aesthetic and stylish, as well as functional;

(H) to provide a bottle-neck-strap that can turn most water bottles into water canteens;

(I) to provide a bottle-neck-strap that can be used for sales promotions;

Still further objects and advantages of my bottle-neck-strap will become apparent from a consideration of the ensuing descripion and drawings.

A BRIEF DESCRIPTION OF DRAWINGS

REFERENCE NUMERALS IN DRAWINGS

Figure 1A:
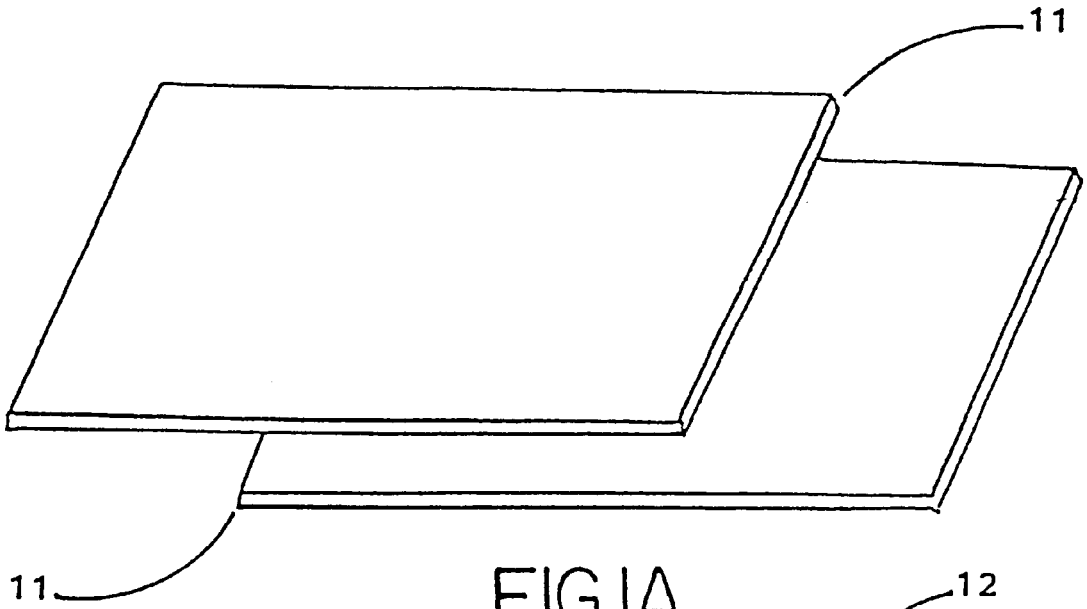
FIGS 1A to 1C shows various aspects of how the bottle-neck-strap is assembled.

10 a bottle-neck-strap
11 the opposite ends where strap is glued
12 shows how the bottle-neck-strap is glued together
13 the bottle-neck-strap-hole
14 shows glued section in relationship to its placement on the bottle-neck of product
15 shows a bottle-neck-collar
16 shows placement of the strap holes on the bottle-neck-collar

DESCRIPTION OF THE PREFERRED EMBODIMENTS

Figure 1B:
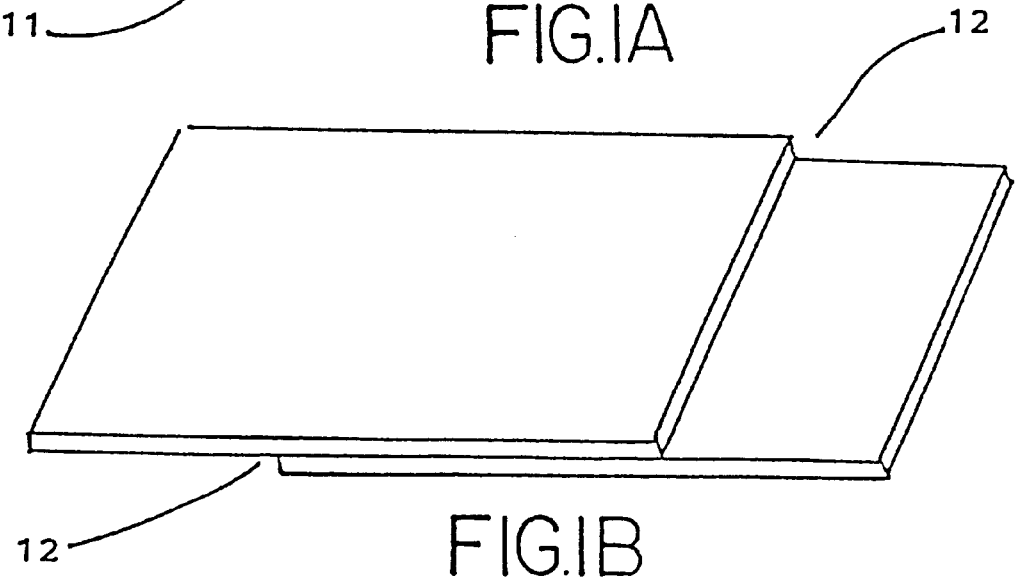
Figure 1C:
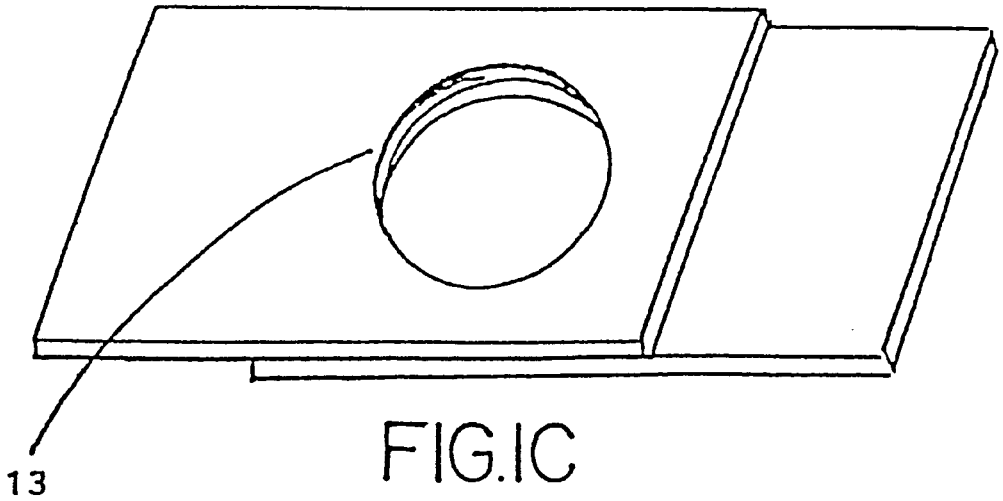

FIGS 1A to 1C Illustrate a flat strap of the present invention, generally designated as reference numeral 10; the bottle-neck-strap is assembled by cutting foam rubber to preferred measurement specification. The opposite ends 11 of the strap are put together 12 and glued, then the bottle-neck-strap-hole 13 is cut out. The glued section of the bottle-neck-strap is where the bottle-neck-hole is cut, but it can be cut in another section of the strap.

Figure 2:
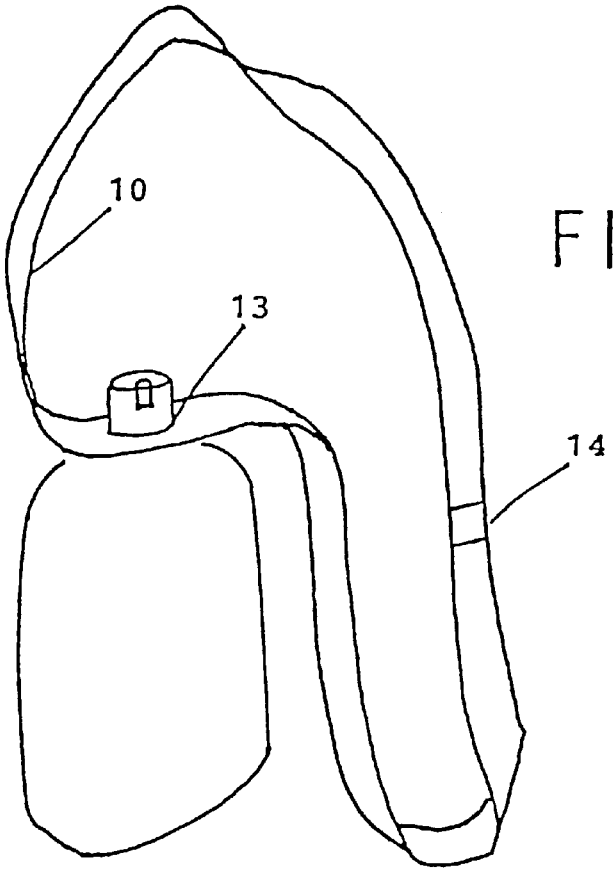
FIG. 2 shows liguid soap bottle fully assembled with the bottle-neck-strap.

FIG. 2 Illustrates present invention attached to a bottle-neck wherein glued section 14 is not used for botttle-neck-strap-hole.

Figure 3:
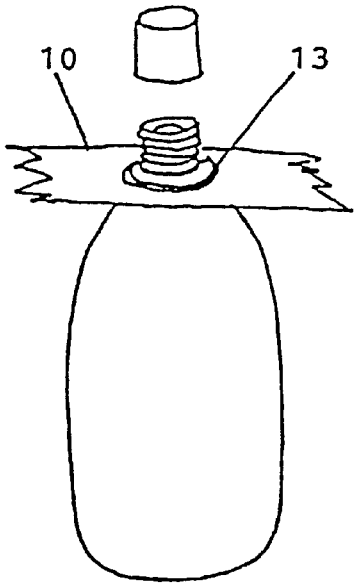
FIG. 3 shows how foam rubber strap fits under the lip or extended rim of the bottle-neck on a water bottle etc.

FIG. 3 Demonstrates how the bottle-neck-strap hole 13 fits under the lip or extended rim on the bottle-neck of some bottles.

Figure 4:
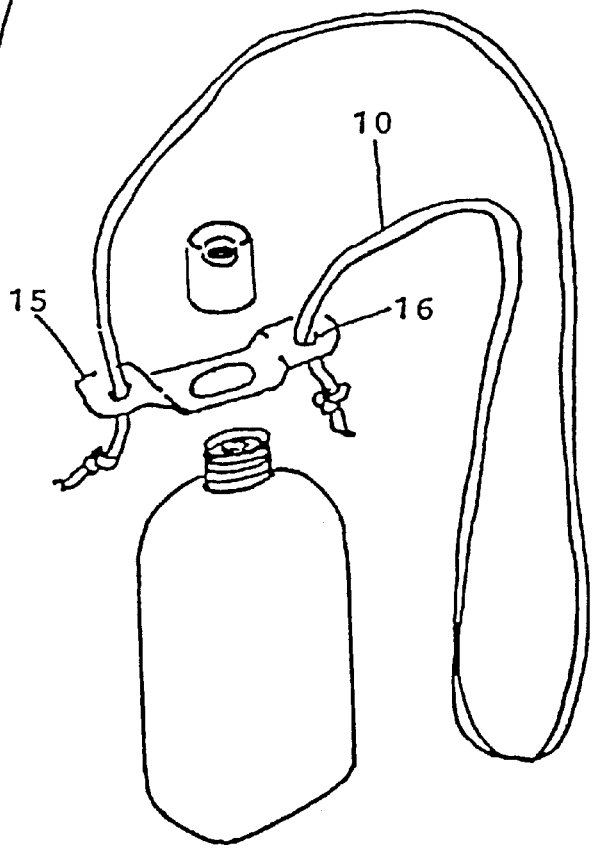
FIG. 4 shows a bottle-neck-collar with a hole at each end.

FIG. 4 Illustrates another ambodiment of the present invention referred to as a bottle-neck-collar 15 which is integral with bottle-neck-strap, but it dose not have to be made out of the same material. The hole 16 at each and of the bottle-neck-collar is used for the bottle-neck-strap which a rope, cord or string is preferred for constructing the bottle-neck-strap, with the bottle-neck-collar.

Figure 5:
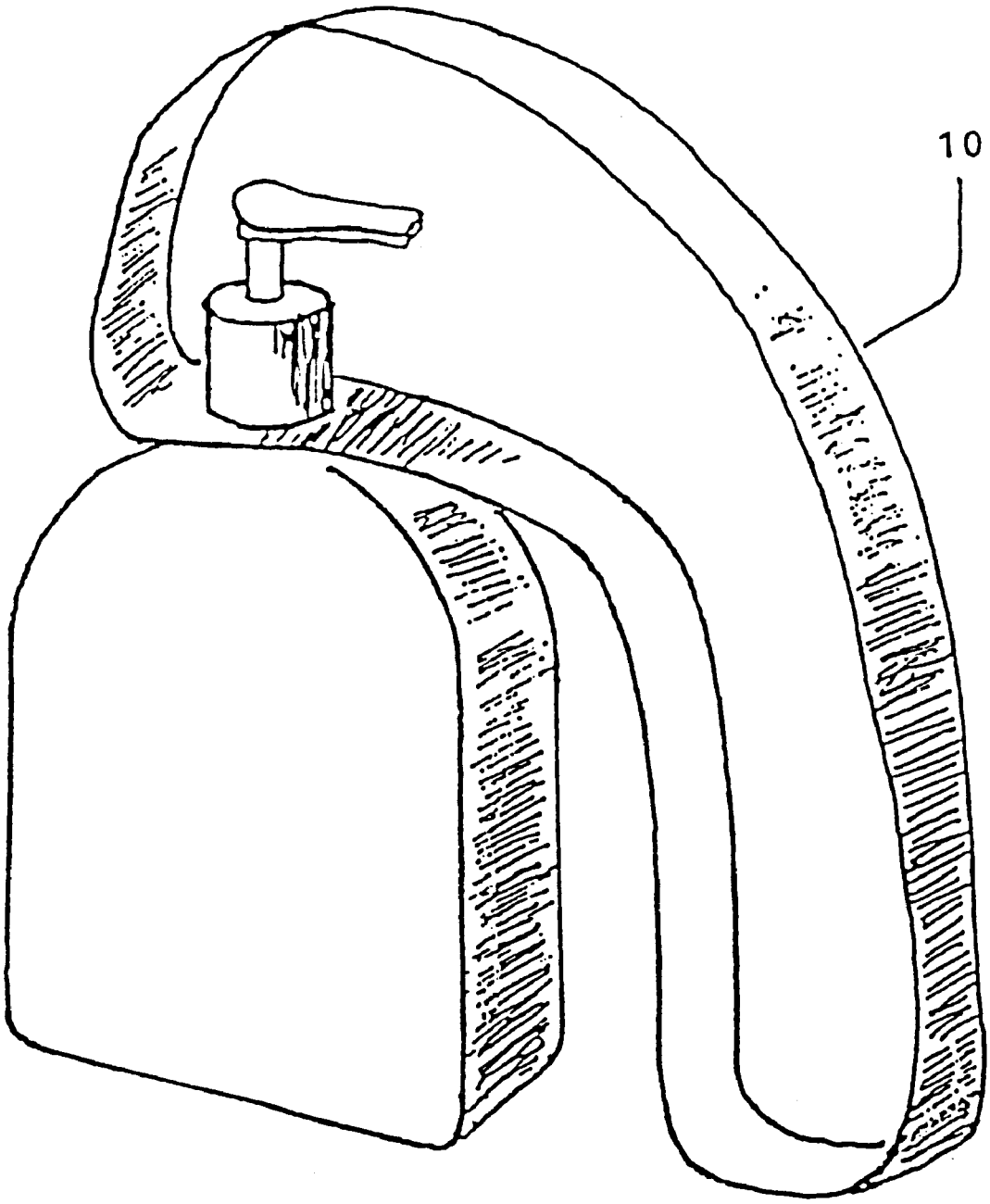
FIG. 5 shows a pump dispensing container fully assembled with the bottle-neck-strap.

FIG. 5 shows a pump dispensing container fully assembled with the bottle-neck-strap.

Operation of Invention

The nuts and bolts of the present invention 10 are a synthetic foam rubber strap with a bottle-neck-hole 13 in it. Since the size of the bottle-neck-hole in the strap is predetermined, the bottle-neck-strap-hole 13 fits tighly around the bottle-neck. when the bottle-neck-strap is made out of foam rubber, the circumference of the bottle-neck-strap-hole is cut smaller then the bottle-neck. Because of the stretchability of synthetic foam rubber, the bottle-neck-strap-hole can be stretched under the rim or lip on bottle-necks that do not have caps with pump or flip tops, thus keeping the bottle-neck-strap tight on the bottle-neck. The bottle-neck-strap-hole fits under the bottle cap, when the bottle-neck cap has a flip or pump top.

This invention relates to a novel type of strap that can be attached to a bottle-neck, specifically, liguid soap, shampoo, suntan lotion, water bottles and many other bottle products. moreover, this strap can be hung around the neck or over the shoulder. It is an additional object of the present invention to provide a strap which is aesthetic and stylish.

The material of the bottle-neck-strap may be any flexible material or fabric useful for straps; polyurethane fabric, Polypropylene fabric, cotton, silk, ethylene-vinyl-acetate are representative useful materials for the practice of this invention. Normally the strap, rope, band, belt of which the bottle-neck-strap is made, would be one material and color, but this is not necessary. Although it would be easier and cheaper for a manufacturer to limit the materials, weights, hand, and color of components to be made and processed, one may choose to contrast the material, weight color, and hand in constructing the bottle-neck-strap.

Preferably the bottle-neck-hole of present invention is integral with the bottle-neck-strap, but this is not necessary to the invention. The bottle-neck-strap can be made in two section; section number one is referred to as a bottle-neck-collar, section two, referred to as a bottle-neck-strap, can be made from a plurality of pieces, likewise for section number one.

Preferred embodiments of the present invention have been described and Illustrated in the accompanying figures by way of example. Numerous modifications thereof may be made without departing from the sprit and scope of the invention for which letters patent are sought, as defined by the following claims:

1. A bottle neck strap for carrying a bottle by its neck comprising:

a band having uniform width and thickness and having overlapping ends secured together to form an endless strap with a double thickness portion where said over lying ends are secured together, said strap being formed of flexible material, said portion defining an opening therethrouigh having a predetennined diameter and smooth sides whereby when the neck of a bottle is forced through said opening said portion will flex and the sides of said opening will grip the neck of the bottle.

2. The strap of claim 1, wherein said band is constructed of rubber.

3. The strap of claim 1, wherein the band is constructed of a member of the group consisting of leather, polyurethane, polypropylene and synthetic foam rubber.

* * * * *